United States Patent [19]

Forehand et al.

[11] Patent Number: 4,776,393

[45] Date of Patent: Oct. 11, 1988

[54] PERFORATING GUN AUTOMATIC RELEASE MECHANISM

[75] Inventors: Donald R. Forehand; Robert A. Turney; Max M. Murray, all of Houston; Thomas D. Ricles, Kingwood, all of Tex.

[73] Assignee: Dresser Industries, Inc., Dallas, Tex.

[21] Appl. No.: 11,950

[22] Filed: Feb. 6, 1987

[51] Int. Cl.[4] ..... E21B 23/04; E21B 43/116

[52] U.S. Cl. ..... 166/55.1; 166/377; 175/4.56

[58] Field of Search ..... 166/55.1, 297, 377; 175/4.56

[56] References Cited

U.S. PATENT DOCUMENTS

| | | | |
|---|---|---|---|
| 4,484,639 | 11/1984 | Ayero | 75/4.56 |
| 4,526,233 | 7/1985 | Stout | 166/377 |
| 4,554,981 | 11/1985 | Davies | 166/55.1 X |
| 4,601,492 | 7/1986 | George | 285/3 |

*Primary Examiner*—Hoang C. Dang

*Attorney, Agent, or Firm*—William R. Peoples; Jerry R. Selinger; Roger N. Chauza

[57] ABSTRACT

Perforating gun automatic release mechanism wherein the perforating gun is linked to the drilling string by a coupling member. The coupling member includes a plurality of collet fingers, by which said coupling member is attached to the drilling string. The heads of the collet fingers, when inserted into the bottom of the drilling string engage a circumferential groove therein. A slidable locking sleeve, coaxially disposed within the coupling member prevents the inward radial movement necessary for the collet finger heads to disengage the groove. The locking sleeve sits on a slidable piston, which is contained inside the coupling member on top of the explosive charge which detonates the perforating gun. Upon detonation, the resulting shock wave traveling upward pushes the piston and locking sleeve to a position where the collet finger heads are free to disengage the groove, which the weight of the perforating gun then causes, dropping the gun, coupling member and all attachments away from the drilling string.

11 Claims, 3 Drawing Sheets

PERFORATING GUN AUTOMATIC RELEASE MECHANISM

BACKGROUND OF THE INVENTION

This invention is concerned with a perforating gun, to be used for piercing hydrocarbon bearing subsurface strata, of the type attached to the end of the drilling string and is lowered to the desired position downhole. More specifically, this invention relates to a mechanism for automatically separating the perforating gun from the drilling string.

After the gun has been fired, if no mechanism exists for releasing it from the drilling string downhole, the drilling string must be completely pulled from the well simply to remove the spent gun. Pulling the string solely for such purpose would be an uneconomical use of time. An automatic release mechanism is therefore a desirable time saver, and forms of such mechanisms are known in the art. For example, U.S. Pat. Nos. 3,966,236 and 4,066,282 disclose automatic release mechanism operated by a fishing tool lowered down through the drilling string on a cable to unlatch the spent gun. Other types of release mechanisms utilize hydraulic pressure to disconnect the gun from the drilling string.

Both of these classes of release mechanisms not only require a discrete step in the operation, and thus an additional expenditure of time, to unlatch the gun, but also require the use of particular tools or machinery, which are of course subject to malfunction. For example, a wireline shifting tool might fail to properly engage the necessary component downhole in the release mechanism, or, once engaged, should said component stick, the cable might pull loose from the tool leaving an obstruction downhole. Or, a hydraulic system might fail to supply sufficient pressure to trigger a release mechanism leaving the perforating gun coupled to the drill string.

One of the most advantageous features of the subject invention is that it operates automatically upon detonation of the perforating gun, and thus eliminates the time taken by additional manipulations and eliminates the risk of the malfunction of other tools. Additionally, the subject invention releases not only the perforating gun but all components necessary to detonate the gun as well, leaving the bore of the drilling string completely unrestricted and eliminating the need for use of a vent assembly.

SUMMARY OF THE INVENTION

A perforating gun automatic release mechanism is provided which utilizes the explosive shock wave resulting from detonation of the gun to activate the release. A coupling member, made up of a bushing sub and a release sub, is used as the mechanical link between the perforating gun and a housing remains coupled to the drilling string after release of the perforating gun. All the components necessary to detonate the perforating gun, although located partially inside the housing, are not themselves attached to the housing and are attached only to the coupling member.

The coupling member is attached to the housing by a plurality of collet fingers located at the top of the coupling member. Each collet finger has a beveled exterior surface forming a head thereon, such heads being received in a circumferential groove of complementary shape inside the housing when the coupling member is inserted into the housing. The perforating gun is attached to the coupling member; and a locking sleeve, which sits inside the collet fingers of the coupling member, denies the collet finger heads space for the inward radial movement necessary to be pulled out of the groove.

The locking sleeve sits on top of a piston; both are located inside the coupling member and both are slidable therein. The piston sits on top of vertical ducts which communicate with the cavity of the coupling member where there is located the explosive charge which detonates the perforating gun. Detonation of the explosive charge provides sufficient explosive shock wave downward to detonate the perforating gun, and also provides an explosive shock wave upward through the ducts. The upward explosive shock wave is sufficient to shift the piston and thus the sleeve upward within the coupling member to an extent sufficient to allow the collet finger heads the inward radial movement necessary to disengage the groove. The weight of the gun is then given effect as a force sufficient to pull the heads out of the groove, taking the coupling member (and all the firing components attached thereto) out of the housing, whereupon they fall into the rathole of the well.

DETAILED DESCRIPTION OF THE PREFERRED EMBODIMENT

Figure 1:
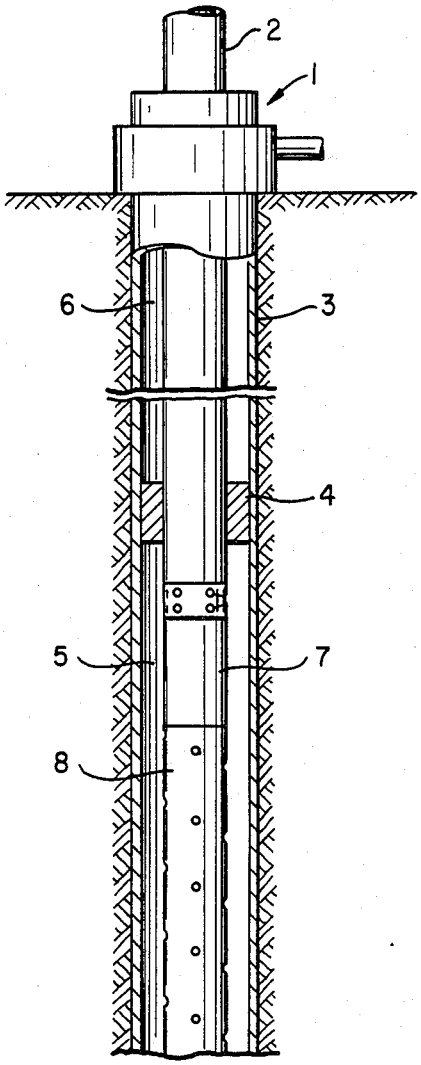
FIG. 1 shows a typical scheme of downhole components wherein the subject invention would be utilized.

In FIG. 1 are shown the general components of the type of downhole perforating arrangement wherein the invention described herein would be used. A well head 1 has a string of drill tubing, a drilling string 2, extending through the interior of a string of casing pipe 3. A suitable packer assembly 4, which can be of any number of commonly used forms, is attached to the drilling string 2 and sealingly engages the casing 3, dividing the casing annulus into a lower 5 and upper 6 annulus, respectively. A tubular section 7 containing a firing mechanism, and an automatic release mechanism in accordance with the present invention, is attached to the bottom of the drilling string 2; and a perforating gun 8 is attached to the bottom of said tubular section 7. Placing said tubular section 7 and gun 8 into the well involves pulling the drilling string 2 completely out of the well so that they can be attached, as aforesaid, to the bottom of the drilling string 2. The drilling string 2, tubular section 7 and gun 8 are then returned to the well for perforating the casing 3 and surrounding formations.

Figure 2A:
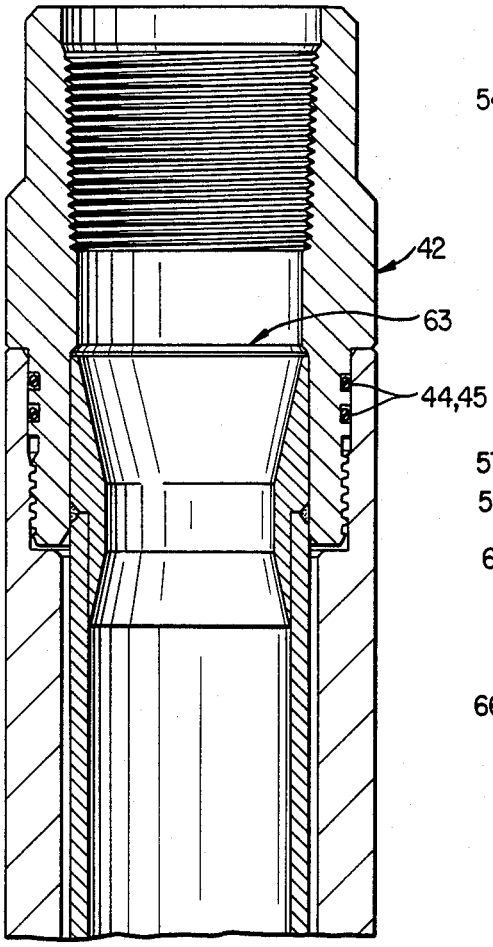
FIGS. 2A and 2B are a detailed side view partially in cross section of the upper portion of the elements of the subject invention.
Figure 2B:
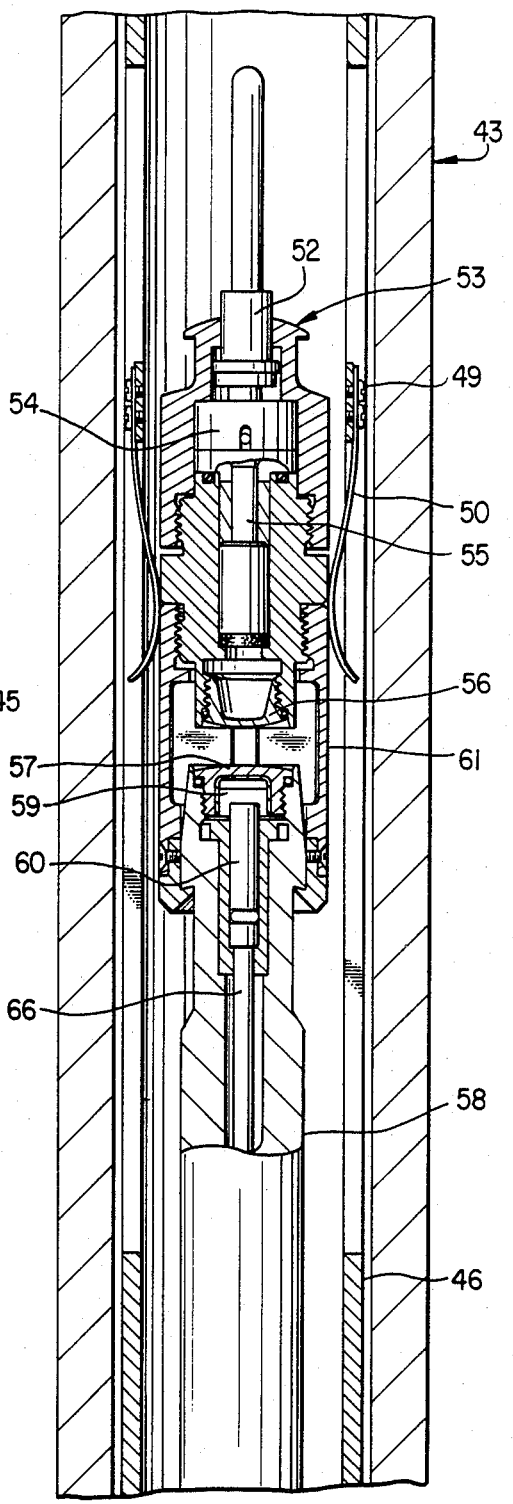
Figure 3A:
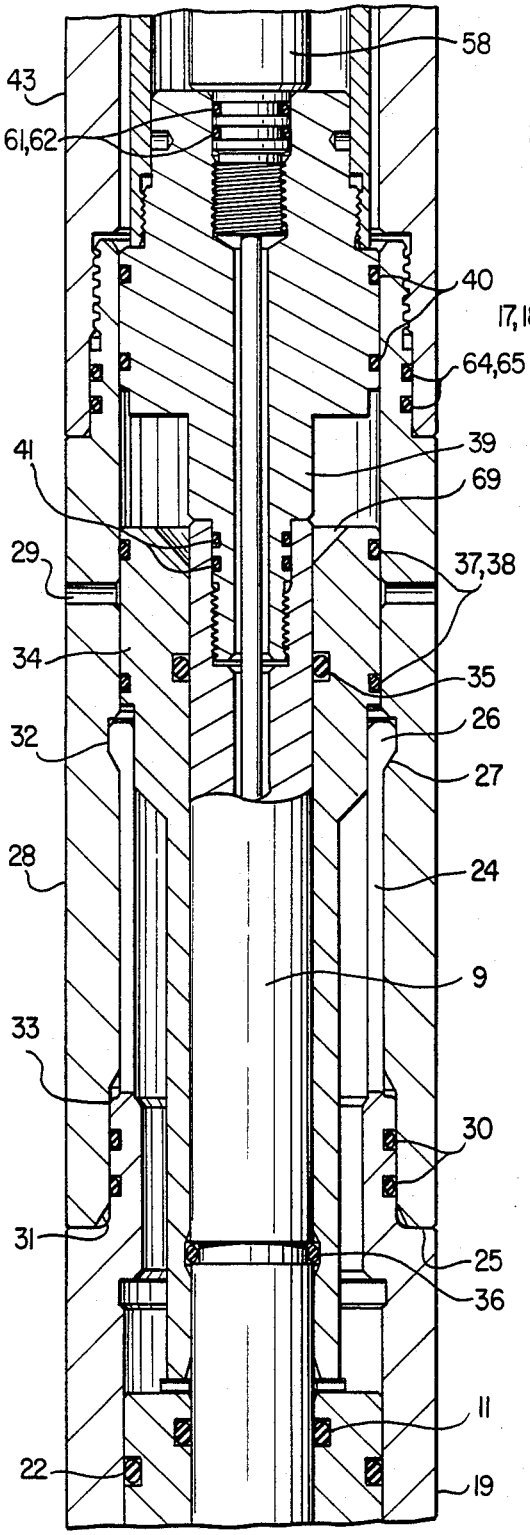
FIGS. 3A and 3B are side views partially in cross section of the lower portion of the elements of the subject invention.
Figure 3B:
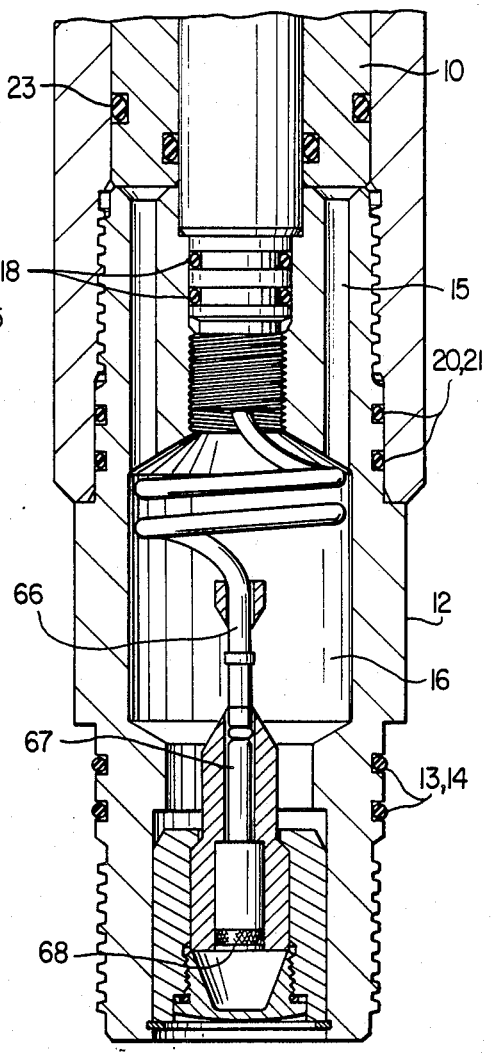

In FIGS. 2 and 3, the details of the tubular section 7 which contains a firing mechanism, and the automatic release mechanism described herein, may be seen.

Referring, first, to the automatic release mechanism, lower arming stem 9, a cylindrical member with an internal bore, is internally screw threaded at its upper end, and is externally screw threaded at its lower end. Actuator piston 10, which is also a cylindrical member with an internal bore is coaxially and slidable disposed around lower arming stem 9. Occlusive seals are furnished therebetween by seal member 11.

Bushing sub 12 is a cylindrical member with an internal bore, is internally screw threaded at its upper end, and is externally screw threaded at both its upper and lower ends. The lower set of external threads is for use in threadably attaching perforating gun 8 to bushing sub 12. Occlusive seals therebetween are furnished by seal members 13 and 14. Contained in the wall of bushing sub 12, at its upper end, are ducts 15. Ducts 15 furnish an unobstructed passage from the top external surface of bushing sub 12 into the cavity 16 formed by the middle portion of the internal bore of bushing sub 12. The lower end of lower arming stem 9 is threadably received within the upper end of bushing sub 12. Occlusive seals therebetween are furnished by seal members 17 and 18. The bottom surface of piston 10 rests on the opening of ducts 15 in the top external surface of bushing sub 12.

Release sub 19 is a cylindrical member, with an internal bore, and is internally screw threaded at its lower end for the purpose of being threadably coupled to the upper end of bushing sub 12. Occlusive seals are furnished at such juncture by seal members 20 and 21. When release sub 19 is threadably coupled to bushing sub 12, actuator piston 10 is coaxially and slidably received within release sub 19. Occlusive seals between actuator position 10 and release sub 19 are furnished by seal members 22 and 23.

The upper end of release sub 19 is a reduced outer diameter portion. Said reduction in diameter forms shoulder 25, above which is located a plurality of collet fingers 24. Each collet finger 24 has a head 26, and cutouts are circumferentially spaced within release sub 19 between said collet fingers 24. The head 26 of each collet finger 24 is formed by a gradual increase in the thickness of the finger, resulting in a bevel 27 in the exterior wall of the finger. The interior wall of each collet finger 24, and the portions of the exterior wall thereof on either side of said bevel 27, are all parallel to each other. The point of greatest thickness of each collet finger 24 is at its head 26, and the outer diameter of release sub 19, at such point, is less than the outer diameter of release sub 19 below shoulder 25.

Reentry sub 28 is a cylindrical member with an internal bore. Reentry sub 28 is externally screw threaded at its upper end, and contains circumferentially spaced ports 29, each of which furnishes an unobstructed passage from said internal bore through to the exterior surface of reentry sub 28. The bottom surface of reentry sub 28 is seated on shoulder 25. Occlusive seals between reentry sub 28 and release sub 19 are furnished by seal member 30.

The diameter of the internal bore of reentry sub 28 is, with two exceptions, less than the outer diameter of release sub 19 measured at the heads 26 of collet fingers 24. The exceptions occur, first, at a groove 32 cut into said internal bore about midway between the top and bottom of reentry sub 28; and, second, in the lower portion of reentry sub 28 where bevel 31 makes transition from the bottom surface of reentry sub 28 to an enlarged-diameter section of the lower portion of said internal bore. The diameter of the internal bore of reentry sub 28 at groove 32 is approximately equal to the outer diameter of release sub 19 measured at the heads 26 of collet fingers 24.

To seat reentry sub 28 on shoulder 25, collet fingers 24 of release sub 19 are inserted into said enlarged-diameter section 33 of reentry sub 28. The cutouts between the collet fingers 24 allow the fingers to become radially compressed when the collet finger heads 26 engage the portion of reentry sub 28 where the internal bore diameter is not enlarged. Further insertion of release sub 19 into reentry sub 28 causes the engagement of collet finger heads 26 by groove 32 to occur simultaneously with the seating of the bottom surface of reentry sub 28 on shoulder 25. The shape of groove 32 is the complement to the shape of collet finger heads 26, and, when said collet finger heads 26 are fully engaged by groove 32, the bottom surface of reentry sub 28 is held tightly and flush against shoulder 25.

Locking sleeve 34, a cylindrical member with an internal bore, is coaxially and slidably disposed around lower arming stem 9. An occlusive seal is furnished therebetween by seal member 35. Vibration damper 36, a compressible gasket encircling lower arming stem 9, resists the slidable insertion of lower arming stem 9 into locking sleeve 34. With sufficient pressure, vibration damper 36 can be forced inside locking sleeve 34, thereby compressing vibration damper 36 and preventing free coaxial movement of locking sleeve 34 and lower arming stem 9 relative to each other. The outer diameter of locking sleeve 34 is greatest at an upper portion where locking sleeve 34 is coaxially and slidably received within the internal bore of reentry sub 28. An occlusive seal is furnished at such location by seal members 37 and 38. Below said upper portion, locking sleeve 34 steps in to a middle, reduced-outer-diameter portion where locking sleeve 34 is coaxially and slidably received inside collet fingers 24. Locking sleeve 34, when located in such position, prevents any radial movement of collet fingers 24 inwardly toward lower arming stem 9, Below said middle portion, locking sleeve 34 is beveled for transition to a lower, further-reduced-outer-diameter portion, and the outer surface of locking sleeve 34 is at this location inside, but does not contact, the internal bore of release sub 19.

Located above lower arming stem 9 is bulkhead 39, a cylindrical member with an internal bore, coaxially disposed within reentry sub 28. An occlusive seal therebetween is furnished by seal member 40. Bulkhead 39 is externally screw threaded at its lower end for coupling to lower arming stem 9, which is corresponding internally screw threaded at its upper end. An occlusive seal is furnished at such location by seal member 41.

Above bulkhead 39 are the portions of tubular section 7 relating to the firing mechanism and to the attachment of tubular section 7 to drilling string 2. Such attachment is made by use of connector sub 42, which is a cylindrical member with an internal bore. Connector sub 42 is internally screw threaded at its upper end for attachment drilling string 2, and is externally screw threaded at its lower end for attachment to pressure housing 43. Pressure housing 43 is a cylindrical member with an internal bore, and is internally screw threaded at its upper end for attachment to connector sub 42. An occlusive seal is furnished therebetween by seal members 44 and 45. Coaxially disposed within pressure housing 43 is guide housing 46, which is a cylindrical member with an internal bore. Attached to guide housing 46, by suitable means such as screws 49, are centralizers 50, which assist in accomplishing the centering of firing assembly 51 within the internal bore of guide housing 46 upon its installation therein.

Firing assembly 51 includes a firing pin 52; a grapple end 53; a cartridge container 54, containing ignition pins and ignition cartridges (not shown); explosive booster charge 55; and a shaped charge 56. Firing assembly 51 couples to the head 57 of upper arming stem 58, which is a cylindrical member with an internal bore. Head 57 also includes an explosive booster charge 59 and an explosive cap 60. To seat firing assembly 51 on head 57, the grapple end 53 is grasped by a delivery tool and is lowered into position through the drilling string 2 on a cable after the perforating gun 8, tubular section 7 and drilling string 2 have all been placed at the desired depth in the well. The use and function of firing assembly 51 in this context is shown in greater detail in U.S. Pat. No. 4,484,639, issued Nov. 27, 1984 to David B. Ayers et al, which is incorporated by reference herein.

Upper arming stem 58 is externally screw threaded at its lower end for attachment to bulkhead 39, which is correspondingly internally screw threaded at its upper end. Occlusive seals are furnished at such locations by seal members 61 and 62. Upper arming stem 58 and firing assembly 51 are fully enclosed within but are not attached to guide housing 46, and guide housing 46 is also threadably attached to the upper end of bulkhead 39. Guide housing 46 is fully enclosed within, but is not attached to, pressure housing 43. The top surface of guide housing 46 abuts but is not attached to a collar 63 present within connector sub 42. Collar 63 prevents movement of guide housing 46 toward drilling string 2 but does not restrict the passageway from the drilling string 2 into the bore of guide housing 46. Pressure housing 43 is internally screw threaded at its lower end for attachment to reentry sub 28, and reentry sub 28 is correspondingly externally threaded at its upper end. Occlusive seals are furnished at such location by seal members 64 and 65.

Detonator cord 66 runs the length of upper arming stem 58, through bulkhead 39 and lower arming stem 9, and into bushing sub 12 where it terminates in explosive booster charge 67 and shaped charge 68. Impact on firing pin 52 will cause detonation, in sequence, of the following: ignition cartridge, explosive booster charge 55, shaped charge 56, explosive booster charge 59, explosive cap 60, detonator cord 66, explosive booster charge 67 and shaped charge 68. It will be recognized by those skilled in the art that the firing assembly 51 used need not be of the impact or percussion type, as shown, but may be of the type which is electrically or hydraulically activated.

Detonation of shaped charge 68 in turn causes detonation of perforating gun 8, which is attached to bushing sub 12 in a manner known in the art. Detonation of shaped charge 68 creates an explosive shock wave, much of which is directed at the perforating gun 8, as aforesaid. However, a significant part of the shock wave resulting from the detonation of shaped charge 68 and detonator cord 66 travels upward in the internal bore of bushing sub 12 toward the internal bore of lower arming stem 9 and through ducts 15 toward actuator piston 10. The shock wave traveling through ducts 15 impinges on piston 10, on which is seated the bottom of locking sleeve 34. Other than O-ring friction, the only impediment to free slidable movement of actuator piston 10 and locking sleeve 34 over the exterior surface of lower arming stem 9 is vibration damper 36. The force of the shock wave is sufficient to overcome such impediment of vibration damper 36, and actuator piston 10 and locking sleeve 34 are both pushed upward until the top of locking sleeve 34 comes to rest against bulkhead 39. Additionally, bevel 69, in the top surface of locking sleeve 34, reduces resistance to the slidable movement of locking sleeve 34 caused by compression of gas or fluid trapped between the top of locking sleeve 34 and bulkhead 39. The middle, reduced-outer-diameter portion of locking sleeve 34 is, after detonation, thus located completely above the heads 26 of collet fingers 24. In such situation, there is no longer any resistance to radial movement of collet fingers 24 inward toward lower arming stem 9.

Prior to detonation, the weight of the perforating gun 8 had been transferred through bushing sub 12 to release sub 19. Such weight was supported by the collet finger heads 26, the beveled face 27 of each of which rested against the complementary surface of groove 32. Such weight would have been sufficient to pull the collet finger heads 26 out of groove 32 had not locking sleeve 34 prevented the necessary inward radial movement of each collet finger 24 to accomplish such removal from groove 32. After detonation, when locking sleeve 34 is no longer in position to prevent such inward radial movement by the collet fingers 24, the weight of the perforating gun 8 is sufficient to cause the collet finger heads 26 to pull out of groove 32. Release of the collet finger heads 26 from groove 32 is also encouraged by neutralizing the upward pressure of the fluid in the lower casing annulus 5 against the bottom of the perforating gun 8. This is accomplished when locking sleeve 34 is pushed up against bulkhead 39 which places the upper, full-diameter portion of locking sleeve 34 above ports 29. The borehole fluid is thereupon free to enter the interior of reentry sub 28 where it pushes down on release sub 19, displacing what was essentially atmospheric pressure inside reentry sub 28 prior to detonation.

As bulkhead 39, and guide housing 46, including all components located within guide housing 46, are not in any manner attached to reentry sub 28 or pressure housing 43, all of said components are also pulled out of reentry sub 28 and pressure housing 43 as the weight of the perforating gun 8 pulls the collet finger heads 26 out of groove 32. This leaves an entirely unobstructed, full bore, passage inside reentry sub 28 and pressure housing 43 for the flow of production fluids through same and into the drilling string 2. Bevel 31 facilitates the introduction into reentry sub 28 of any logging tools later lowered through the drilling string 2 on a cable and out into the borehole through the bottom of reentry sub 28.

While only a particular embodiment of the present invention and modes of practicing same have been shown and described, it is apparent that changes and modifications thereto may be made within the scope of the appended claims without departing from the true spirit of this invention, and the foregoing disclosure and description of this invention are not intended as a limitation thereon.

The embodiments of the invention in which an exclusive property or privilege is claimed are defined as follows:

1. Apparatus for disconnecting a perforating gun from a string of drill tubing, comprising:

a housing member attached to said drilling string;

a coupling member attached to said perforating gun;

locking means for releasably connecting said housing member to said coupling member;

piston means associated with said coupling member and slideable within a chamber for cooperating with said locking means, and responsive to detonation of said perforating gun for sliding from a first position which maintains said housing member locked to said coupling member to a second position for disconnecting said housing member from said coupling member; and a port in said housing member for communicating annulus fluid between said piston chamber and a well annulus;

a valve which closes said port when said piston is in said first position, and said valve is responsive to said piston moving to said second position for opening and allowing annulus pressure to enter said housing member and assist in removal of said coupling member from said housing member.

2. The apparatus of claim 1 wherein said coupling member further comprises a first end for attachment to said perforating gun and a second end for insertion into said housing member.

3. The apparatus of claim 2 wherein said locking means for connecting said housing member to said coupling member comprise a locking member, disposed within said coupling member, to prevent release of said second end of said coupling member from within said housing member.

4. The apparatus of claim 3 wherein said piston means is responsive to detonation of said perforating gun to shift said locking means within said coupling member to allow release of said second end of said coupling member from within said housing member.

5. The apparatus of claim 2 wherein said housing member further comprises an internal bore for receipt of said second end of said coupling member, and a plurality of passages defining a plurality of said ports, each extending from the exterior of said housing member to said internal bore.

6. Apparatus for disconnecting a perforating gun from a string of drill tubing, comprising:

a housing member attached to said drilling string, said housing member having a bore with an internal annular groove, and a port in a sidewall of said housing member;

a coupling member having a first end for attachment to said perforating gun and a second end for insertion into the bore of said housing member for connection thereto, said coupling member having a plurality of finger heads attached thereto and engageable with said annular groove for releasably attaching said coupling member to said housing member;

an arming assembly held within said coupling member and actuable for causing a detonation;

a first cylindrical piston sealed to and moveable between said arming assembly and said coupling member, said first piston being operative to move from a first position covering said port and maintaining said finger heads engaged with said annular groove, to a second position uncovering said port and allowing said finger heads to become released from said groove;

a second cylindrical piston sealed to and moveable between said arming assembly and said coupling member, said second piston being responsive to said detonation for engaging said first piston and moving said first piston from said first position to said second position to thereby effect withdrawal of said coupling member from said housing member for disconnection therefrom.

7. The apparatus of claim 6 wherein said coupling member further includes a bushing sub attached thereto, said bushing sub having a plurality of ducts to channel a shock wave resulting from detonation of said perforating gun to said second piston for moving said second piston.

8. The apparatus of claim 1 further including a plurality of finger heads fixed to said coupling member and releasably engageable with said housing member, said piston means being cylindrical and moveable in said housing member from a first position maintaining said finger heads engaged with said housing member and sealing said port, to a second position wherein said port is opened and said finger heads are released from engagement with said housing member.

9. The apparatus of claim 8 wherein said piston means defines a first piston, and further including a second piston responsive to said detonation for moving said first piston from said first position to said second position.

10. The apparatus of claim 9 further including an arming assembly disposed centrally within said coupling member, and wherein said second piston moves in sealing engagement between said arming assembly and said coupling member.

11. The apparatus of claim 6 further including a vibration damper between said first piston and said arming assembly.

* * * * *